United States Patent [19]

Balonier et al.

[11] Patent Number: 5,056,246

[45] Date of Patent: Oct. 15, 1991

[54] DEVICE FOR TAKING TROUSERS OFF AN IRONING MACHINE

[75] Inventors: Nikolaus Balonier, Maintalstr. 34, D-8750 Aschaffenburg-Obernau, Fed. Rep. of Germany; Ottmar Promper, Neuhofen, Austria

[73] Assignee: Nikolaus Balonier, Aschaffenburg-Obernau, Fed. Rep. of Germany

[21] Appl. No.: 427,722

[22] Filed: Oct. 27, 1989

[51] Int. Cl.[5] ..... D06F 71/28

[52] U.S. Cl. ..... 38/7; 38/12; 38/15; 38/28; 38/8; 38/143

[58] Field of Search ..... 38/10, 7, 8, 9, 11, 38/12, 64, 143; 270/10, 20.1, 30, 39; 414/788.9, 789.9, 790.2; 223/74, 75

[56] References Cited

U.S. PATENT DOCUMENTS

| | | | |
|---|---|---|---|
| 3,622,146 | 11/1971 | Adachi | 38/28 X |
| 4,137,655 | 2/1979 | Engelbart | 38/27 X |
| 4,143,476 | 3/1979 | Holmes | 38/7 |
| 4,542,601 | 9/1985 | Cartabbia | 38/7 |
| 4,729,181 | 3/1988 | Weir | 38/143 |
| 4,741,233 | 5/1988 | Mershon | 270/30 X |
| 4,834,359 | 5/1989 | Raabe | 270/31 |

FOREIGN PATENT DOCUMENTS

| | | | |
|---|---|---|---|
| 0134875 | 3/1985 | European Pat. Off. . | |
| 6932665 | 5/1969 | Fed. Rep. of Germany . | |
| 1966172 | 5/1972 | Fed. Rep. of Germany . | |
| 2704176 | 5/1978 | Fed. Rep. of Germany . | |
| 3510896 | 10/1986 | Fed. Rep. of Germany . | |
| 3733715 | 4/1988 | Fed. Rep. of Germany . | |
| 2091299 | 7/1982 | United Kingdom | 38/7 |
| 2098633 | 11/1982 | United Kingdom | 38/8 |
| 2099025 | 12/1982 | United Kingdom | 38/8 |

OTHER PUBLICATIONS

Hugo Schafer, SAMAB in Mailand, *Bekleidung + Wasche* 15, 1986, S. 11.

*Primary Examiner*—Werner H. Schroeder
*Assistant Examiner*—Ismael Izaguirre
*Attorney, Agent, or Firm*—Norman E. Brunell

[57] ABSTRACT

A device for taking trousers off a double-leg ironing machine having an ironing board receiving the trouser legs in spread position, a gripper mounted for motion along the ironing board including two clamping plates arranged in the transverse direction of the ironing board at least one of which is mounted for vertical motion and can be lowered to the surface of the ironing board. The gripper grips, raises and transports one trouser leg along the longitudinal axis of the board and releases it at the end of the other trouser leg. This positions the ends of the trouser legs together so that they can be gripped manually or mechanically and held by a clamping hanger for further transport. A transport system is provided.

10 Claims, 3 Drawing Sheets

DEVICE FOR TAKING TROUSERS OFF AN IRONING MACHINE

BACKGROUND OF THE INVENTION

1. Field of the Invention

This invention relates to a device for taking trousers off a double-leg ironing machine having a split ironing board for receiving the trouser legs in a spread position.

2. Description of the Prior Art

Conventional double leg ironing machines make it possible to iron both trouser legs simultaneously. The trouser legs are placed stretched out in the longitudinal direction on a split ironing board, having a gap in the middle through which the waistband hangs down. After completion of the ironing operation, conventional techniques require manual removal of the trousers from the ironing board. It is necessary in doing so to place the two trouser legs carefully over one another. The trousers are then usually clamped in a clamping hanger gripping the hem of both trouser legs.

SUMMARY OF THE INVENTION

The preceding and other shortcomings of the prior art are addressed and overcome by the present invention that provides a device for removing trousers from a double leg ironing board including a gripping means mounted for motion along the ironing board having at least one clamping plate mounted for vertical motion from the surface of the ironing board and automatic means for actuating the gripping means to grip a first end of a first trouser leg, raise the first end above the ironing board, move the first end to the end of the second trouser leg and release the first end there.

In a further aspect, the present invention provides a wedge which can be pushed under the ends of the trouser legs, a clamping hanger, means for positioning the clamping hanger in an open state adjacent the trouser ends, means for closing the clamping hanger, and means for transporting the clamping hanger and trousers from the ironing board.

DETAILED DESCRIPTION OF THE PREFERRED EMBODIMENT(S)

In accordance with the various embodiments of the present invention, a gripper travels along the longitudinal axis of the ironing board and grips the end of a freshly ironed trouser leg while a bottom clamping plate of the gripper, in the shape of a flat blade, moves below the hem of the trouser leg and another clamping plate presses against the hem from above. The hem of this trouser leg is then raised slightly by the gripper and moved along the ironing board in the direction of the waist band, pulling the trouser leg along in a loop. The gripper travels beyond the waistband to the end of the other trouser leg creasing releases the gripped hem to fold the trousers without Both trouser legs can then be gripped together by a clamping hanger in the region of the hems to remove the trousers from the ironing board. Movement of the gripper and hangers are sensor controlled for automatic sensing of trouser length.

Two parallel ironing machines can by operated mounted alternately. Each ironing machine provided with a gripper for motion along that board. A clamping hanger and trouser removal device can travel in the transverse direction between the machines so that trousers can be removed from one machine while an operator places unpressed trousers on the other machine. In this manner, two ironing machines can conveniently be operated by one person.

Figure 1:
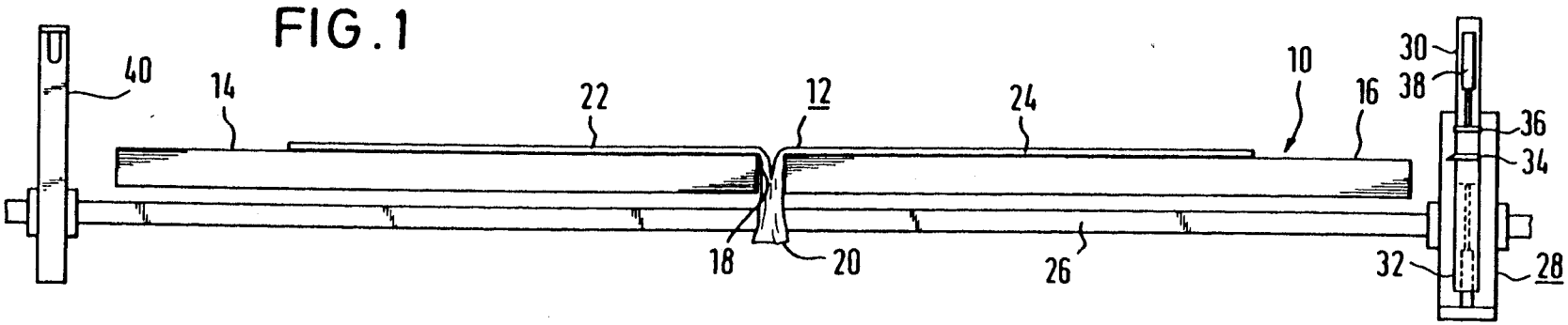
Figure 2:
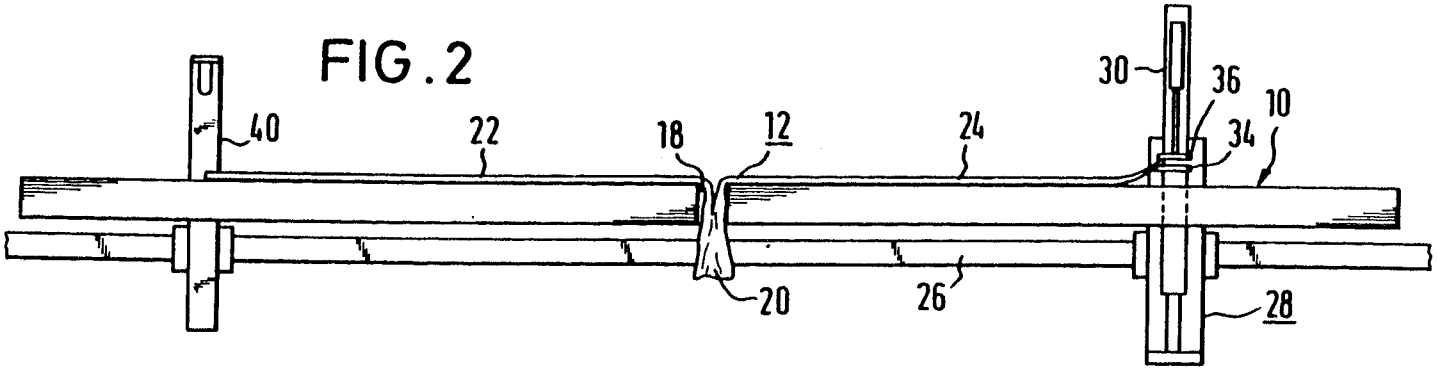
Figure 3:
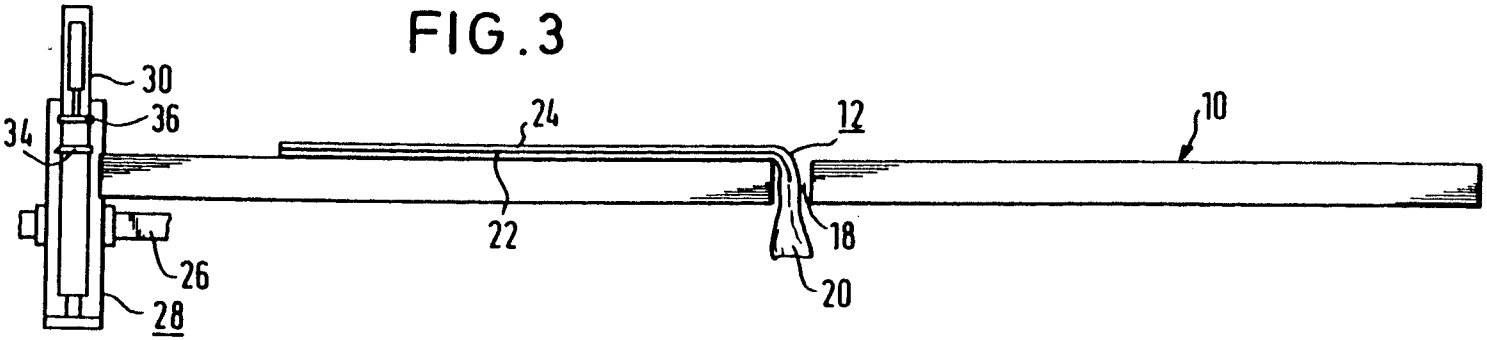

A first embodiment of the present invention for automatically folding freshly ironed trousers is shown in various operating positions in FIGS. 1 through 3.

As shown in FIG. 1, freshly ironed trousers 12 lie on ironing board 10 which forms the lowest part of an ironing press, the rest of which is not shown. Ironing board 10 includes board parts 14 and 16 mutually aligned along the longitudinal axis of ironing board 10 direction, spaced apart by gap 18 for accommodating waistband 20. Trouser legs 22 and 24 lie on board parts 14 and 16, respectively.

In accordance With the present invention, a mechanism for laying trouser legs 22 and 24 over one another includes guide rail which is arranged along ironing board to and on which gripper support 28 travels. With the assistance of lifting cylinder 32, gripper 30 moves vertically with respect to gripper support 28. Gripper 30 includes clamping plates 34 and 36 which extend transversely over ironing board 10 or any extension thereof. Top clamping plate 36 moves vertically with respect to bottom clamping plate 34 in response to the action of closing cylinder 38. As shown in FIG. 1, bottom clamping plate 34 is at the same level as the upper surface of ironing board 10 and is in the shape of a flat blade or wedge so that it pushes under the hem of trouser leg 24 when gripper support 28 is moved toward waistband 20 as shown in FIG. 2.

On optical sensor, not shown, is mounted on gripper 30 to scan the end of trouser leg 24 and stops gripper support 28 as soon as the hem of trouser leg 24 is between clamping plates 34 and 36. In this position, as shown in FIG. 2, the hem is gripped by closing clamping plates 34 and 36 and raised slightly by actuation of lifting cylinder 32.

Optical sensor 40 travels on guide rail 26 and scans for the end of trouser leg 22 In FIG. 1, optical sensor 40 is shown in an initial position at One end of board part 14. Optical sensor 40 moves along the longitudinal axis of ironing board 10 over board part 4 and halts as soon as it detects the hem of trouser leg 22, as shown in FIG. 2. In response to a control device or system not shown, the position reached by optical sensor 40 shown in FIG. 2, that is, the detected hem of trouser leg 22, is stored or memorized as a target position for gripper support 28. Gripper support 28 is them moved out of the position shown in FIG. 2 into this target position, displacing optical sensor in the direction of its initial position. Trouser leg 24 is moved along by movement of gripper 30 to that it is positioned over trouser leg 22. Gripper support 28 continues traveling into the end position shown in FIG. 3 and thereby displaces optical sensor 40 into its initial position again. Thereafter, gripper 30 is raised and moved back over freshly ironed trousers 12 again into the initial position shown in FIG. 1.

Figure 4:
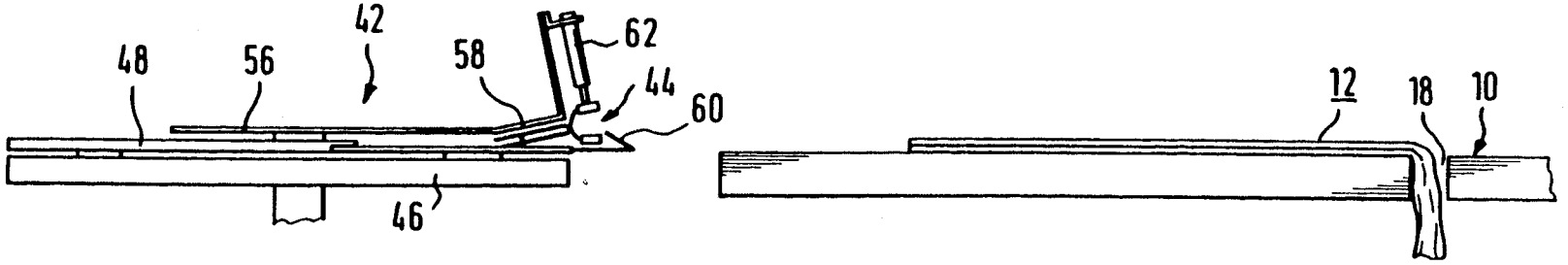
Figure 5:
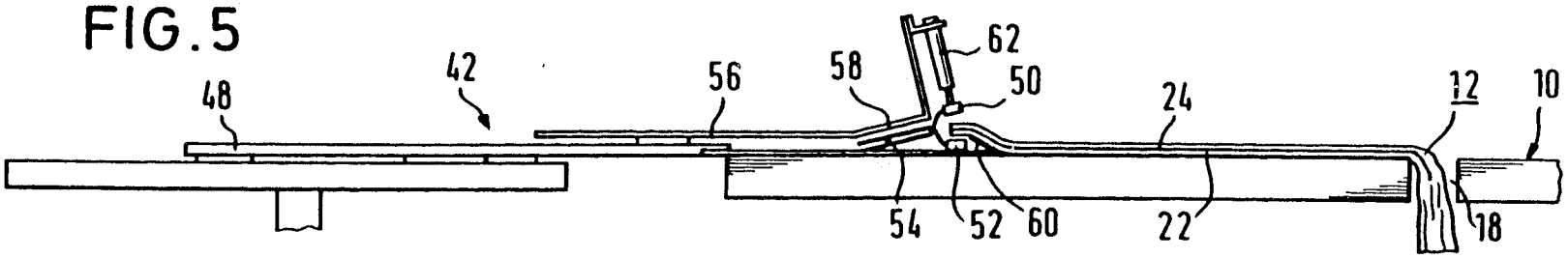
Figure 6:
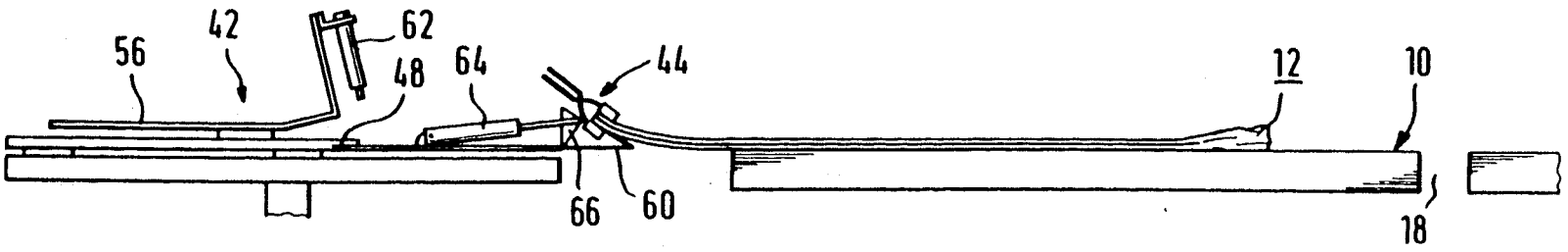

A further embodiment of the present invention for clamping freshly ironed trousers 12 in trouser clamping hanger 44, after trouser legs 22 and 24 have been placed together, and for removing freshly ironed trousers 12 from ironing board 10, is shown in FIGS. 4 through 6.

As shown in FIG. 4, gripping device 42 includes table 46 on which slide 48 is mounted for motion along the longitudinal axis of ironing board 10 Slide 48 dispenses trouser clamping hanger 44 in an open position towards the hem of freshly ironed trousers 12 from a magazine, not shown, adjacent gripping device 42.

Trouser clamping hanger 44 includes clamping jaws 50 and 52 and hanger member 54 configured from a resilient wire bow bent in the form of a hook as shown in FIG. 5. Hanger member 54 has two legs which cross one another in the region of their free ends which are terminated by clamping jaws 50 and 52, respectively, and held in a normally closed position by spring tension of the resilient wire.

A mechanism for opening trouser clamping hanger 44 includes additional slide 56 mounted for motion on slide 48 along the longitudinal axis of ironing board 10. Slide 56 includes at its front end oblique pressure plate 58 which, as shown in FIGS. 5 and 6, compresses the legs of hanger member 54 to hold trouser clamping hanger 44 in the open position.

Bottom clamping jaw 52 is mounted behind wedge 60 formed at the front end of slide 48 so that when slide 48 advances as shown in FIG. 5, wedge 60 pushes under the ends of trouser legs 22 and 24 and clamping jaws 50 and 52 can grip them from opposite sides.

Actuation of closing cylinder 62, mounted at the front end of slide 56, presses clamping jaw 50 against clamping jaw 52 to grip the hem of freshly ironed trousers 12. Thereafter, slide 48 returns toward its initial position so that freshly ironed trousers 12 are pulled off ironing board 10 along its longitudinal axis. When the final position for gripping device 42 is approached, as shown in FIG. 6, closing cylinder 62 is deactivated and slide 56 continues to move without trouser clamping hanger 44. Trouser clamping hanger 44 is held in its normally closed position by the spring action of hanger member 54. Lever 66 is mounted for pivotal motion on slide 48 and, when actuated by air cylinder 64, raises hanger member 54 of trouser clamping hanger 44 as shown in FIG. 6.

Figure 7:
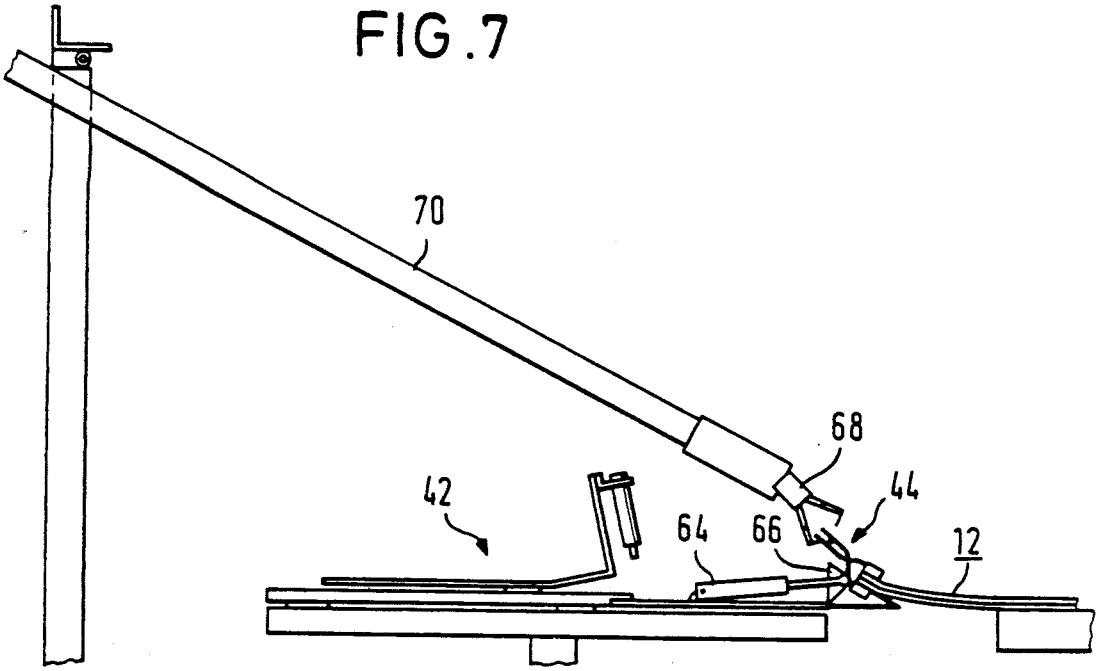
Figure 8:
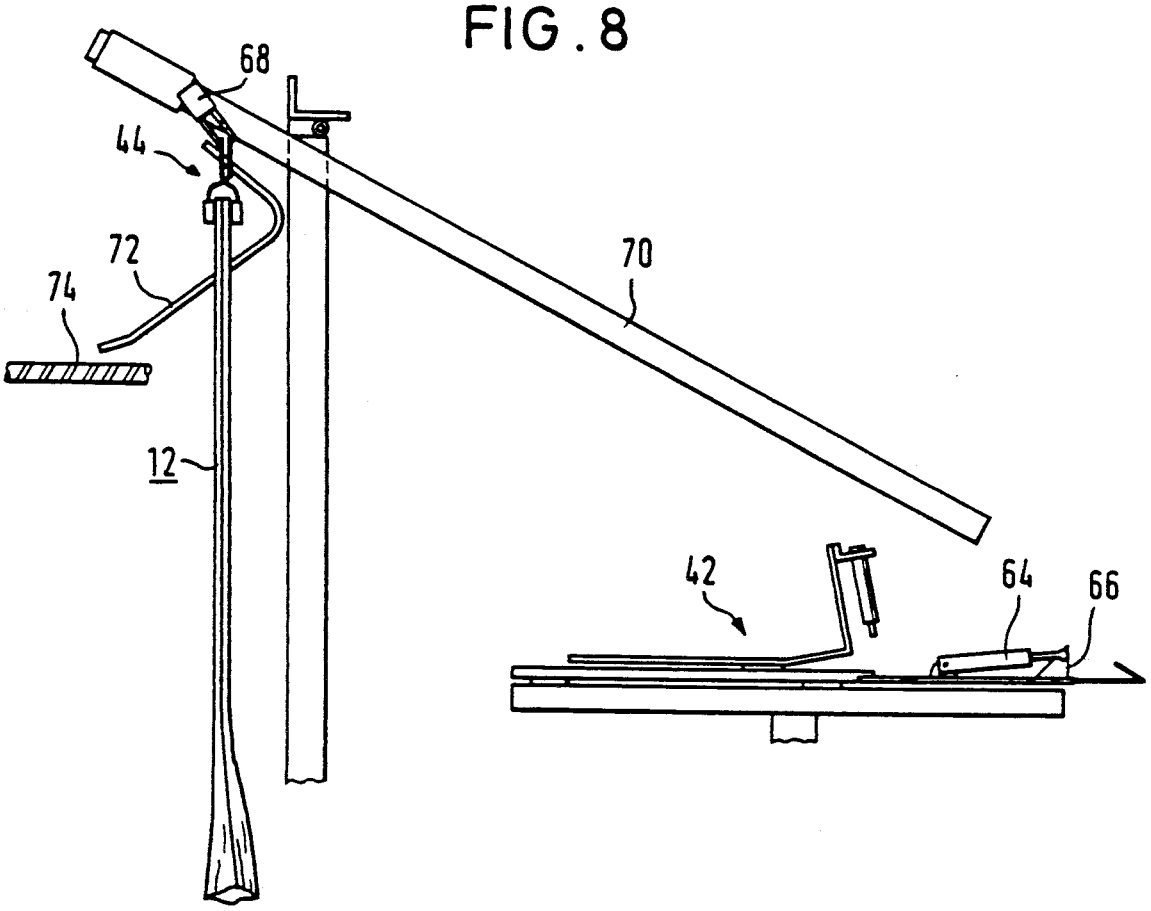

A further embodiment of the present invention, for gripping and transporting freshly ironed trousers 12 away from ironing board 10 after trouser legs 22 and 24 have been clamped by trouser clamping hanger 44, is shown in FIGS. 7 and 8.

Trouser clamping hanger 44 is gripped in a partially upright position by gripper 68 and drawn obliquely upwards along rail 70 until freshly ironed trousers 12 finally hang freely on trouser clamping hanger 44. Trouser clamping hanger 44 is then transferred from gripper 68 via slide bar 72 to worm conveyor screw 74 which transports freshly ironed trousers 12 to another work station, such as a machine not shown for ironing waistband 20. Lever 66 returns its idle position in which it lies flat on the surface of slide 48 ready to receive another trouser clamping hanger 44 from the magazine not shown. After receiving another trouser clamping hanger 44, slide 56 is moved back into the position shown in FIG. 4 so that a new operation cycle can begin. Where a plurality of ironing boards 10 each provided with the embodiment of the invention shown in FIGS. 1 through 3 are operating, gripping device 42 may be moved in a transverse direction into a new work position at another ironing board 10.

While this invention has been described with reference to its presently preferred embodiment, its scope is not limited thereto. Rather, such scope is only limited insofar as defined by the following set of claims and includes all equivalents thereof.

We claim as our Invention:

1. A device for removing trousers from a double leg ironing board, comprising:

gripping means mounted for motion along the ironing board including at least one clamping plate mounted for vertical motion from the surface of the ironing board; and automatic means for actuating the gripping means to grip a first end of a first trouser leg, raise the first end above the ironing board, and release the first end at an end of a second trouser leg.

2. The trouser removal device claimed in claim 1, further comprising:

second gripping means for gripping the ends of the trouser legs together to remove the trousers from the ironing board.

3. The trouser removal device claimed in claim 2, wherein the second gripping means further comprises:

a wedge which is pushable under the ends of the trouser legs;

a clamping hanger;

means for positioning the clamping hanger in an open state adjacent the trouser leg ends;

means for closing the clamping hanger to grip the trouser leg ends; and means for transporting the clamping hanger gripping the trousers from the ironing board.

4. The trouser removal device claimed in claim 3 wherein clamping hanger includes a pair of jaws and the closing means further comprises:

jaw closing means mounted for motion into a position where it acts upon one of the jaws.

5. The trouser removal device claimed in claim 3 further comprising:

means for positioning the second gripping means to receive another clamping hanger.

6. The trouser removal device claimed in claim 3 wherein the means for positioning the clamping hanger further comprises:

ramp means mounted for motion with the jaw closing means for opening the clamping hanger.

7. The trouser removal device claimed in claim 3 further comprising:

lever means for raising the clamping hanger above the ironing board after closure.

8. The trouser removal device claimed in claim 3 wherein the means for transporting the clamping hanger and trousers further comprises:

a rail positioned obliquely upward from the ironing board; and transport gripping means mounted for motion along the rail for gripping the clamping hanger.

9. The trouser removal device claimed in claim 3 wherein the means for transporting the clamping hanger and trousers is mounted for motion transverse to the ironing board for use with another ironing board.

10. The trouser removal device claimed in claim 3, further comprising:

means for automatically sensing the end of one trouser leg.

* * * * *

UNITED STATES PATENT AND TRADEMARK OFFICE

CERTIFICATE OF CORRECTION

PATENT NO. : 5,056,246

DATED : Oct. 15, 1991

INVENTOR(S) : Balonier & Promper

It is certified that error appears in the above-identified patent and that said Letters Patent is hereby corrected as shown below:

| | | |
|---|---|---|
| COL. 1 | LINE 57 | After "without" insert -- creasing.--; |
| COL. 1 | LINE 64 | Delete "mounted"; |
| COL. 1 | LINE 65 | After "gripper" insert --mounted--; |
| COL. 2 | LINE 15 | Replace "With" insert --with--; |
| COL. 2 | LINE 17 | After "rail' insert --26--; |
| COL. 2 | LINE 18 | After "board" insert --10--; |

UNITED STATES PATENT AND TRADEMARK OFFICE

CERTIFICATE OF CORRECTION

PATENT NO. : 5,056,246

DATED : Oct. 15, 1991

INVENTOR(S) : Balonier & Promper

It is certified that error appears in the above-identified patent and that said Letters Patent is hereby corrected as shown below:

COL. 2 LINE 40 After "22" insert -- . --;

COL. 2 LINE 41 Replace "One" with --one--;

COL. 2 LINE 43 Replace "4" with --14--;

COL. 2 LINE 51 After "sensor" insert --40--;

Col. 2, Line 67, After "10" insert --. --.

Signed and Sealed this

Sixteenth Day of February, 1993

*Attest:*

STEPHEN G. KUNIN

*Attesting Officer*

*Acting Commissioner of Patents and Trademarks*